US011352583B2

(12) United States Patent
Aoki et al.

(10) Patent No.: US 11,352,583 B2
(45) Date of Patent: Jun. 7, 2022

(54) LUBRICANT COMPOSITION

(71) Applicant: IDEMITSU KOSAN CO., LTD., Chiyoda-ku (JP)

(72) Inventors: Shinji Aoki, Sodegaura (JP); Shota Hirakawa, Fukuoka (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 16/321,916

(22) PCT Filed: Aug. 7, 2017

(86) PCT No.: PCT/JP2017/028616
§ 371 (c)(1),
(2) Date: Jan. 30, 2019

(87) PCT Pub. No.: WO2018/034189
PCT Pub. Date: Feb. 22, 2018

(65) Prior Publication Data

US 2019/0177648 A1 Jun. 13, 2019

(30) Foreign Application Priority Data

Aug. 18, 2016 (JP) ..... JP2016-160567

(51) Int. Cl.

| | |
|---|---|
| ***C10M 169/04*** | (2006.01) |
| ***C10M 137/08*** | (2006.01) |
| ***C10M 105/38*** | (2006.01) |
| ***C10M 133/12*** | (2006.01) |
| ***C10M 105/34*** | (2006.01) |
| *C10N 20/02* | (2006.01) |
| *C10N 20/04* | (2006.01) |
| *C10N 30/02* | (2006.01) |
| *C10N 30/10* | (2006.01) |
| *C10N 30/12* | (2006.01) |
| *C10N 30/00* | (2006.01) |
| *C10N 40/02* | (2006.01) |
| *C10N 40/04* | (2006.01) |
| *C10N 40/06* | (2006.01) |
| *C10N 40/08* | (2006.01) |
| *C10N 40/12* | (2006.01) |
| *C10N 40/30* | (2006.01) |
| *C10N 40/00* | (2006.01) |

(52) U.S. Cl.

CPC ..... *C10M 169/04* (2013.01); *C10M 105/34* (2013.01); *C10M 105/38* (2013.01); *C10M 133/12* (2013.01); *C10M 137/08* (2013.01); *C10M 2207/023* (2013.01); *C10M 2207/026* (2013.01); *C10M 2207/2835* (2013.01); *C10M 2207/34* (2013.01); *C10M 2209/1033* (2013.01); *C10M 2209/1055* (2013.01); *C10M 2215/064* (2013.01); *C10M 2215/065* (2013.01); *C10M 2215/068* (2013.01); *C10M 2215/223* (2013.01); *C10M 2219/044* (2013.01); *C10M 2223/04* (2013.01); *C10M 2223/041* (2013.01); *C10M 2223/043* (2013.01); *C10N 2020/02* (2013.01); *C10N 2020/04* (2013.01); *C10N 2030/02* (2013.01); *C10N 2030/10* (2013.01); *C10N 2030/12* (2013.01); *C10N 2030/24* (2020.05); *C10N 2030/45* (2020.05); *C10N 2040/02* (2013.01); *C10N 2040/04* (2013.01); *C10N 2040/06* (2013.01); *C10N 2040/08* (2013.01); *C10N 2040/12* (2013.01); *C10N 2040/135* (2020.05); *C10N 2040/30* (2013.01)

(58) Field of Classification Search

CPC ..... C10N 2240/30; C10N 2240/08; C10N 2240/14; C10N 2240/12; C10N 2230/02; C10N 2230/12; C10N 2230/10; C10N 2040/08; C10N 2040/30; C10N 2020/09; C10M 2207/023; C10M 2209/1055; C10M 2207/2835; C10M 2215/068; C10M 2215/064

See application file for complete search history.

(56) References Cited

U.S. PATENT DOCUMENTS 6,656,891 B1 * 12/2003 Sakanoue ..... C10M 145/36 508/579
2007/0284078 A1 * 12/2007 Leck ..... C09K 5/045 165/58

(Continued)

FOREIGN PATENT DOCUMENTS

CN 101338241 A 1/2009
CN 101784645 A 7/2010

(Continued)

OTHER PUBLICATIONS

Office Action dated Jun. 2, 2021, in Chinese Patent Application No. 201780047907.5 filed Aug. 7, 2017.
Indonesian Office Action dated Feb. 24, 2021 in Indonesian Appiication No. PID201900831, 2 pages.
International Search Report dated Oct. 10, 2017 in PCT/JP2017/028616 filed on Aug. 7, 2017.

(Continued)

*Primary Examiner* — Vishal V Vasisth
(74) *Attorney, Agent, or Firm* — Oblon, McClelland, Maier & Neustadt, L.L.P.

(57) ABSTRACT

Provided is a lubricating oil composition comprising a base oil (A) containing a polyalkylene glycol (A1) and a polyol ester (A2), a phosphorus-based rust inhibitor (B), and an antioxidant (C) containing an amine-based antioxidant (C1). The lubricating oil composition exhibits a strong effect for suppressing sludge sedimentation even when used for an extended period of time in a high-temperature environment, and has excellent demulsibility and rust preventive properties, and therefore, can be suitably used in turbomachinery, compressors, hydraulic equipment, and machine tools.

20 Claims, No Drawings

(56) References Cited

U.S. PATENT DOCUMENTS

| | | | | |
|---|---|---|---|---|
| 2009/0054283 | A1 | 2/2009 | Page et al. | |
| 2010/0087349 | A1* | 4/2010 | Lee | C10M 111/04 508/499 |
| 2010/0105589 | A1 | 4/2010 | Lee et al. | |
| 2011/0039739 | A1 | 2/2011 | Greaves et al. | |
| 2012/0004152 | A1* | 1/2012 | Page | C10M 107/34 508/501 |
| 2015/0051126 | A1 | 2/2015 | Sato | |
| 2016/0215235 | A1 | 7/2016 | Kaneko | |

FOREIGN PATENT DOCUMENTS

| | | | |
|---|---|---|---|
| CN | 102066537 | A | 5/2011 |
| CN | 102690717 | A | 9/2012 |
| CN | 103695133 | A | 4/2014 |
| CN | 104220569 | A | 12/2014 |
| CN | 105567385 | A | 5/2016 |
| CN | 105602677 | A | 5/2016 |
| JP | 60-63297 | A | 4/1985 |
| JP | 11-35960 | A | 2/1999 |
| JP | 11-35964 | A | 2/1999 |
| JP | 11-279578 | A | 10/1999 |
| JP | 2004-67770 | A | 3/2004 |
| JP | 2008-239763 | A | 10/2008 |
| JP | 2010-537003 | A | 12/2010 |
| JP | 2011-162774 | A | 8/2011 |
| JP | 2011-236314 | A | 11/2011 |
| JP | 2015-189888 | A | 11/2015 |
| JP | 2016-104858 | A | 6/2016 |
| JP | 2019-508562 | A | 3/2019 |
| JP | 6777457 | B2 | 10/2020 |
| WO | WO 2008/038571 | A1 | 4/2008 |
| WO | WO 2013/146805 | A1 | 10/2013 |

OTHER PUBLICATIONS

Office Action dated Jan. 7, 2020 in Japanese Patent Application No. 2016-160567, (with unedited computer generated English translation), 11 pages.

* cited by examiner

LUBRICANT COMPOSITION

This application is a 371 of PCT/JP2017/028616, filed Aug. 7, 2017.

TECHNICAL FIELD

The present invention relates to a lubricating oil composition used in turbomachinery, compressors, hydraulic equipments, or machine tools, and a method of using the lubricating oil composition.

BACKGROUND ART

A lubricating oil composition for use in instruments including various turbomachinery such as steam turbines and gas turbines, compressors such as rotary gas compressors and reciprocating compressors, hydraulic equipments, and hydraulic units of machine tools is used while circulating in a high-temperature environment system for a long period of time.

When the lubricating oil composition is used for a long time under high temperature environments, it is susceptible to sludge precipitation according to oxidative deterioration. The precipitated sludge adheres to, for example, a bearing of a rotor to generate heat, thereby providing a risk of bearing damage, or may clog a filter arranged in a circulation line, or may deposit on a control valve, thereby often causing control system operation failures, etc.

Therefore, improvement in the effect of suppressing sludge precipitation is required for the lubricating oil composition which is used while circulating in a high-temperature environment system for a long period of time.

For example, PTL 1 discloses a lubricating oil composition for air compressors, the composition including a synthetic base oil which is a mixed oil of a polyglycol-based synthetic oil and an ester-based synthetic oil, and one or more amine-based antioxidants selected from a specific compound group such as asymmetric diphenylamine-based compounds.

According to PTL 1, the lubricating oil composition for air compressors shows a result of suppressing sludge precipitation while appropriately suppressing oxidation.

CITATION LIST

Patent Literature

PTL 1: WO2013/146805

SUMMARY OF INVENTION

Technical Problem

However, a lubricating oil composition used in instruments such as turbines which may be contaminated with water or steam is emulsified by contamination with water or steam, which is a factor causing troubles in instruments. For this reason, the lubricating oil composition used in such instruments is required to be hardly emulsified and to be easily separated from water even when emulsified, that is, to be excellent in demulsibility.

Further, when the instrument is composed of iron or the like, contamination of water or steam may cause rust on the surface of the instrument as it is used under high temperature environments. Therefore, the lubricating oil composition which is assumed to be contaminated with water or steam and circulates in a high-temperature environment system for a long period of time is also required to have excellent rust preventive properties.

In PTL 1, studies have not been conducted on demulsibility and rust preventive properties of the lubricating oil composition.

An object of the present invention is to provide a lubricating oil composition having a strong effect of suppressing sludge precipitation even when used for a long period of time under high temperature environments, and having excellent demulsibility and rust preventive properties, wherein the lubricating oil composition is used in turbomachinery, compressors, hydraulic equipments, or machine tools.

Solution to Problem

The present inventors found that a lubricating oil composition containing a base oil containing a polyalkylene glycol (hereinafter, referred to as "PAG") and a polyol ester (hereinafter, referred to as "POE"), a phosphorus-based rust inhibitor, and an amine-based antioxidant can solve the above problem, thereby completing the present invention.

That is, the present invention provides the following [1] and [2].

[1] A lubricating oil composition, which is to be used in turbomachinery, compressors, hydraulic equipments, or machine tools, comprising a base oil (A) containing a polyalkylene glycol (A1) and a polyol ester (A2), a phosphorus-based rust inhibitor (B), and an antioxidant (C) containing an amine-based antioxidant (C1).

[2] A method of using a lubricating oil composition, using the lubricating oil composition of [1] in turbomachinery, compressors, hydraulic equipments, or machine tools.

Advantageous Effects of Invention

A lubricating oil composition of the present invention has a strong effect of suppressing sludge precipitation even when used for a long period of time under high temperature environments, is excellent in demulsibility and rust preventive properties, and is suitable for use in turbomachinery, compressors, hydraulic equipments, or machine tools.

DESCRIPTION OF EMBODIMENTS

In the following description, kinematic viscosity and viscosity index mean values measured and calculated in accordance with JIS K2283.

The content of a phosphorus atom or a metal atom means a value measured in accordance with JPI-5S-38-92.

The content of a nitrogen atom means a value measured in accordance with JIS K2609.

[Lubricating Oil Composition]

A lubricating oil composition of the present invention includes a base oil (A) containing a polyalkylene glycol (A1) and a polyol ester (A2), a phosphorus-based rust inhibitor (B), and an antioxidant (C) containing an amine-based antioxidant (C1), wherein the lubricating oil composition is used in turbomachinery, compressors, hydraulic equipments, or machine tools.

The lubricating oil composition of one embodiment of the present invention may further include a metal deactivator (D) as long as the effects of the present invention are not impaired, and may include additives for a lubricating oil other than the components (B) to (D).

In the lubricating oil composition of one embodiment of the present invention, the total content of the components (A), (B), and (C) is preferably 70% by mass to 100% by mass, more preferably 80% by mass to 100% by mass, still more preferably 90% by mass to 100% by mass, and even still more preferably 95% by mass to 100% by mass, based on the total amount (100% by mass) of the lubricating oil composition.

In the lubricating oil composition of one embodiment of the present invention, the total content of the components (A), (B), (C), and (D) is preferably 70% by mass to 100% by mass, more preferably 80% by mass to 100% by mass, still more preferably 90% by mass to 100% by mass, and even still more preferably 97% by mass to 100% by mass, based on the total amount (100% by mass) of the lubricating oil composition.

Hereinafter, each of the components included in the lubricating oil composition of one embodiment of the present invention will be described.

<Component (A): Base Oil>

A base oil (A) included in the lubricating oil composition of the present invention contains a polyalkylene glycol (A1) and a polyol ester (A2).

The base oil (A) used in one embodiment of the present invention may further contain a synthetic oil or a mineral oil other than the components (A1) and (A2) as long as the effects of the present invention are not impaired.

In the lubricating oil composition of the present invention, polyol ester (POE) in combination with PAG are used as the base oil (A), and thus it is possible to achieve both the effect of suppressing sludge precipitation and the effect of suppressing deterioration of demulsibility.

In particular, additives such as a phosphorus-based rust inhibitor (B) and an antioxidant (C) described below are blended with the base oil (A) whose polarity has been moderately adjusted by using PAG and POE in combination, thereby effectively suppressing deterioration of demulsibility due to blending of the additives. Furthermore, it is possible to further improve the effects (rust preventive properties and oxidation stability) due to blending of the additives.

Here, when only PAG is used as the base oil (A), PAG tends to excessively deteriorate according to use under high temperature environments, and oxidation stability decreases and thus sludge precipitation easily occurs.

Further, when only POE is used as the base oil (A), degradation products are generated according to use over a long period of time under high temperature environments, and sludge is easily precipitated, and deterioration of demulsibility due to blending of the additives is easily caused.

Therefore, PAG and POE are used in combination, thereby suppressing deterioration of PAG by the presence of POE, and dissolving degradation products by the presence of PAG. As a result, it is possible to provide the lubricating oil composition capable of effectively suppressing sludge precipitation and suppressing deterioration of demulsibility by blending of the additives.

Further, in an instrument using a lubricating oil composition containing a mineral oil, when the deteriorated previously used lubricating oil composition containing the mineral oil is removed and replaced by the lubricating oil composition of the present invention, the lubricating oil composition of the present invention is compatible with the mineral oil in the previously used lubricating oil composition remaining in the system of the instrument, because the lubricating oil composition of the present invention contains POE.

Further, since the lubricating oil composition of the present invention contains PAG, deterioration products remaining in the previously used lubricating oil composition remaining in the system of the instrument are dissolved to suppress sludge precipitation.

In the lubricating oil composition of one embodiment of the present invention, a content ratio [(A1)/(A2)] of the component (A1) and the component (A2) is preferably 15/85 or more, more preferably 20/80 or more, still more preferably 25/75 or more, and even still more preferably 27/73 by a mass ratio, from the viewpoint of providing a lubricating oil composition capable of improving the effect of suppressing sludge precipitation and effectively suppressing deterioration of demulsibility due to blending of additives.

Further, a content ratio [(A1)/(A2)] of the component (A1) and the component (A2) is preferably 95/5 or less, more preferably 90/10 or less, still more preferably 80/20 or less, and even still more preferably 70/30 or less by a mass ratio from the viewpoint of providing a lubricating oil composition suppressing excessive deterioration of PAG according to use, having excellent oxidation stability, and having the strong effect of suppressing sludge precipitation, and still more preferably 49/51 or less, and even still more preferably 45/55 or less from the viewpoint of providing a lubricating oil composition capable of further improving rust preventive properties and effectively suppressing deterioration of demulsibility due to blending of additives.

Further, the viscosity index of the base oil (A) used in one embodiment of the present invention is preferably 90 or more, more preferably 100 or more, still more preferably 110 or more, and even still more preferably 120 or more.

In the lubricating oil composition of one embodiment of the present invention, the content of the base oil (A) is preferably 60% by mass or more, more preferably 70% by mass or more, more preferably 75% by mass or more, still more preferably 80% by mass or more, even still more preferably 85% by mass or more, and preferably 99.9% by mass or less, and more preferably 99.0% by mass or less, based on the total amount (100% by mass) of the lubricating oil composition.

Further, in the lubricating oil composition of one embodiment of the present invention, the total content of the components (A1) and (A2) of the base oil (A) is preferably 70% by mass to 100% by mass, more preferably 80% by mass to 100% by mass, still more preferably 90% by mass to 100% by mass, and even still more preferably 95% by mass to 100% by mass, based on the total amount (100% by mass) of the base oil (A) contained in the lubricating oil composition.

[Component (A1): Polyalkylene Glycol]

Examples of the polyalkylene glycol (A1) include polymers obtained by polymerization or copolymerization of alkylene oxide.

Further, the polyalkylene glycol (A1) may be used alone or in combination of two or more kinds thereof.

A number average molecular weight (Mn) of the polyalkylene glycol (A1) used in one embodiment of the present invention is preferably 300 to 10,000, more preferably 400 to 5,000, still more preferably 500 to 3,000, and even still more preferably 600 to 1,500 from the viewpoint of improving the viscosity index of the lubricating oil composition.

Further, in the present description, the number average molecular weight (Mn) is a value as expressed in terms of standard polystyrene, measured by gel permeation chromatography (GPC), and measurement conditions include conditions described in Examples.

Further, the polyalkylene glycol (A1) used in one embodiment of the present invention is preferably a polyalkylene glycol of which at least one end is sealed with a substituent, from the viewpoint of providing a lubricating oil composition which is further improved in the effect of suppressing sludge precipitation.

Examples of the substituent capable of sealing the end of the polyalkylene glycol include a monovalent hydrocarbon group having 1 to 10 carbon atoms, an acyl group having 2 to 10 carbon atoms, or a heterocyclic group having 3 to 10 ring atoms, and preferably, a monovalent hydrocarbon group having 1 to 10 carbon atoms.

Further, examples of specific groups regarding the monovalent hydrocarbon group, acyl group, and heterocyclic group that can be selected as the substituent, and the range of the preferable number of the carbon atoms or ring atoms is the same as defined in $R^{A1}$ and $R^{A3}$ in the following formula (a-1).

In one embodiment of the present invention, the polyalkylene glycol (A1) is preferably a compound represented by the following general formula (a-1), from the viewpoint of providing a lubricating oil composition which is further improved in the effect of suppressing sludge precipitation.

$$R^{A1}—[(OR^{A2})_a—OR^{A3}]_b \quad \text{(a-1)}$$

In the general formula (a-1), $R^{A1}$ is a hydrogen atom, a monovalent hydrocarbon group having 1 to 10 carbon atoms, an acyl group having 2 to 10 carbon atoms, a divalent to hexavalent hydrocarbon group having 1 to 10 carbon atoms, or a heterocyclic group having 3 to 10 ring atoms.

$R^{A2}$ is an alkylene group having 2 to 4 carbon atoms.

$R^{A3}$ is a hydrogen atom, a monovalent hydrocarbon group having 1 to 10 carbon atoms, an acyl group having 2 to 10 carbon atoms, or a heterocyclic group having 3 to 10 ring atoms.

b is an integer of 1 to 6, preferably an integer of 1 to 4, more preferably 1 to 3, and still more preferably 1.

Further, b is determined according to the number of the binding site with $R^{A1}$ in the general formula (a-1).

For example, when $R^{A1}$ is a monovalent hydrocarbon group such as an alkyl group or a cycloalkyl group, or an acyl group, b is 1. In other words, when $R^{A1}$ is a hydrocarbon group or a heterocyclic group, and the valence of the group is 1, 2, 3, 4, 5, and 6, b is 1, 2, 3, 4, 5 and 6, respectively.

a is a number of 1 or more, and is a value appropriately determined according to the value of the number average molecular weight of the compound represented by the general formula (a-1).

Further, when two or more different kinds of the compound represented by general formula (a-1) are used, a is an average value (a weighted average value), and the average value may be 1 or more.

Further, when there are a plurality of $R^{A2}$ and $R^{A3}$, $R^{A2}$ and $R^{A3}$ may be the same as or different from each other.

In one embodiment of the present invention, at least one of $R^{A1}$ and $R^{A3}$ in the general formula (a-1) is preferably a monovalent hydrocarbon group having 1 to 10 carbon atoms, an acyl group having 2 to 10 carbon atoms, a divalent to hexavalent hydrocarbon group having 1 to 10 carbon atoms, or a heterocyclic group having 3 to 10 ring atoms, and more preferably a monovalent hydrocarbon group having 1 to 10 carbon atoms.

Examples of the monovalent hydrocarbon group having 1 to 10 carbon atoms which can be selected as $R^{A1}$ and $R^{A3}$ include alkyl groups such as a methyl group, an ethyl group, a propyl group (a n-propyl group, an isopropyl group), a butyl group (a n-butyl group, an isobutyl group, an s-butyl group, a t-butyl group), a pentyl group, a hexyl group, a heptyl group, an octyl group, a nonyl group, and a decyl group; cycloalkyl groups such as a cyclopentyl group, a cyclohexyl group, a methylcyclohexyl group, an ethylcyclohexyl group, a propylcyclohexyl group, and a dimethyl cyclohexyl group; aryl groups such as a phenyl group, a methylphenyl group, an ethylphenyl group, a dimethyl phenyl group, a propyl phenyl group, a trimethylphenyl group, a butylphenyl group, and a naphthyl group; arylalkyl groups such as a benzyl group, a phenylethyl, a methylbenzyl group, a phenylpropyl group, and a phenylbutyl group.

Further, the alkyl group may be either linear or branched.

The number of carbon atoms of the monovalent hydrocarbon group is preferably 1 to 10, more preferably 1 to 6, and still more preferably 1 to 4.

The hydrocarbon group moiety in the acyl group having 2 to 10 carbon atoms which can be selected as $R^{A1}$ and $R^{A3}$ may be linear, branched, or cyclic. The hydrocarbon group moiety includes those having 1 to 9 carbon atoms among the monovalent hydrocarbon groups which can be selected as $R^1$ and $R^3$.

Further, the number of carbon atoms of the acyl group is preferably 2 to 10, and more preferably 2 to 6.

The divalent to hexavalent hydrocarbon group which can be selected as $R^{A1}$ includes residues obtained by removing 1 to 5 hydrogen atoms from the monovalent hydrocarbon group which can be selected as $R^{A1}$ and residues obtained by removing a hydroxy group from polyhydric alcohols, such as trimethylolpropane, glycerin, pentaerythritol, sorbitol, 1,2,3-trihydroxycyclohexane, and 1,3,5-trihydroxycyclohexane.

Further, the number of carbon atoms of the divalent to hexavalent hydrocarbon group is preferably 1 to 10, more preferably 1 to 6, and still more preferably 1 to 4.

The heterocyclic group having 3 to 10 ring atoms which can be selected as $R^{A1}$ and $R^{A3}$ is preferably an oxygen atom-containing heterocyclic group or a sulfur atom-containing heterocyclic group. Further, the heterocyclic group may be a saturated ring or an unsaturated ring.

Examples of the oxygen atom-containing heterocyclic group include residues obtained by removing 1 to 6 hydrogen atoms from an oxygen atom-containing saturated heterocyclic ring, such as 1,3-propylene oxide, tetrahydrofuran, tetrahydropyran, and hexamethylene oxide, and an oxygen atom-containing unsaturated heterocyclic ring, such as acetylene oxide, furan, pyran, oxycycloheptatriene, isobenzofuran, and isochromene.

Examples of the sulfur atom-containing heterocyclic group include residues obtained by removing 1 to 6 hydrogen atoms from a sulfur atom-containing saturated heterocyclic ring, such as ethylene sulfide, trimethylene sulfide, tetrahydrothiophene, tetrahydrothiopyran, and hexamethylene sulfide, and a sulfur atom-containing unsaturated heterocyclic ring, such as acetylene sulfide, thiophene, thiapyran, and thioterpyridine.

The number of ring atoms of the heterocyclic group is preferably 3 to 10, more preferably 3 to 6, and still more preferably 5 or 6.

Examples of the alkylene group having 2 to 4 carbon atoms that can be selected as $R^{A2}$ include an alkylene group having 2 carbon atoms, such as an ethylene group ($—CH_2CH_2—$) and an ethylidene group ($—CH(CH_3)—$); an alkylene group having 3 carbon atoms, such as a trimethylene group ($—CH_2CH_2CH_2—$), a propylene group ($—CH(CH_3)CH_2—$), a propylidene group ($—CHCH_2CH_3—$), and an isopropylidene group ($—C(CH_3)_2—$); and an alkylene group having 4 carbon atoms, such as a tetramethylene group (—$CH_2CH_2CH_2CH_2$—), a 1-methyltrimethylene group (—$CH(CH_3)CH_2CH_2$—), a 2-methyltrimethylene group (—$CH_2CH(CH_3)CH_2$—), and a butylene group (—$C(CH_3)_2CH_2$—).

Further, when there are a plurality of $R^{A2}$s, $R^{A2}$s may be the same as each other or may be a combination of two or more kinds of alkylene groups.

Among them, $R^{A2}$ is preferably a propylene group (—$CH(CH_3CH_2$—).

In the compound represented by the general formula (a-1), the content of the oxypropylene unit (—$OCH(CH_3)CH_2$—) is preferably 50% by mol to 100% by mol, more preferably 65% by mol to 100% by mol, and still more preferably 80% by mol to 100% by mol, based on the total amount (100% by mol) of the oxyalkylene unit ($OR^{A2}$) in the structure of the compound.

The kinematic viscosity at 40° C. of the polyalkylene glycol (A1) used in one embodiment of the present invention is preferably 8 $mm^2/s$ to 350 $mm^2/s$, more preferably 10 $mm^2/s$ to 150 $mm^2/s$, still more preferably 12 $mm^2/s$ to 100 $mm^2/s$, and even still more preferably 15 $mm^2/s$ to 68 $mm^2/s$.

Further, the viscosity index of the polyalkylene glycol (A1) used in one embodiment of the present invention is preferably 90 or more, more preferably 100 or more, still more preferably 110 or more, and even still more preferably 120 or more.

In the lubricating oil composition of one embodiment of the present invention, the content of the polyalkylene glycol (A1) is preferably 15% by mass or more, more preferably 20% by mass or more, still more preferably 25% by mass or more, and even still more preferably 27% by mass or more, based on the total amount (100% by mass) of the lubricating oil composition, from the viewpoint of providing a lubricating oil composition which is further improved in the effect of suppressing sludge precipitation and the effect of suppressing deterioration of demulsibility due to blending of additives, and preferably 95% by mass or less, more preferably 90% by mass or less, still more preferably 80% by mass or less, and even still more preferably 70% by mass or less, from the viewpoint of providing a lubricating oil composition securing the content of the component (A2), suppressing excessive deterioration of the component (A1) according to use, and having excellent oxidation stability and strong effect of suppressing sludge precipitation.

[Component (A2): Polyol Ester]

Examples of the polyol ester (A2) include a hindered ester of a hindered polyol, which has one or more quaternary carbon atoms in the molecule wherein at least one of the quaternary carbon atoms has 1 to 4 methylol groups bonded thereto, with an aliphatic monocarboxylic acid.

The polyol ester (A2) may be used alone or in combination of two or more kinds thereof.

Further, the polyol ester (A2) is generally a complete ester in which all the hydroxy groups of the polyol are esterified, but may include a partial ester in which some of the hydroxy groups remain unesterified, as long as the effects of the present invention are not impaired.

The hindered polyol is preferably a compound represented by the following general formula (a-2).

(a-2)

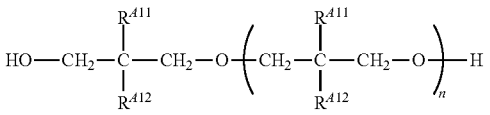

In the general formula (a-2), $R^{A11}$ and $R^{A12}$ are each independently a monovalent hydrocarbon group having 1 to 6 carbon atoms or a methylol group (—$CH_2OH$).

n represents an integer of 0 to 4, preferably 0 to 2, more preferably 0 or 1, and still more preferably 0.

Examples of the monovalent hydrocarbon group having 1 to 6 carbon atoms which can be selected as $R^{A11}$ and $R^{A12}$ include alkyl groups having 1 to 6 carbon atoms (a methyl group, an ethyl group, a propyl group, a butyl group, a pentyl group, a hexyl group), a cyclopentyl group, a cyclohexyl group, and a phenyl group.

Further, the alkyl group may be either linear or branched.

Among them, the monovalent hydrocarbon group having 1 to 6 carbon atoms which can be selected as $R^{A11}$ and $R^{A12}$ is preferably an alkyl group having 1 to 6 carbon atoms, and more preferably an alkyl group having 1 to 3 carbon atoms.

Examples of the compound represented by the following general formula (a-2) include a hindered polyol such as a dialkylpropanediol (wherein the alkyl group has 1 to 6 carbon atoms), a trimethylolalkane (wherein the alkane has 2 to 7 carbon atoms), and a pentaerythritol, and a dehydrated condensate thereof, and more specifically, neopentyl glycol, 2-ethyl-2-methyl-1,3-propanediol, 2,2-diethyl 1,3-propanediol, trimethylolethane, trimethylolpropane, trimethylolbutane, trimethylolpentane, trimethylolhexane, trimethylolheptane, pentaerythritol, 2,2,6,6-tetramethyl-4-oxa-1,7-heptanediol, 2,2,6,6,10,10-hexamethyl-4,8-dioxa-1,11-undecadiol, 2,2,6,6,10,10,14,14-octamethyl-4,8,12-trioxa-1,15-pentadecadiol, 2,6-di(hydroxymethyl)-2,6-dimethyl-4-oxa-1,7-heptanediol, 2,6,10-tri(hydroxymethyl)-2,6,10-trimethyl-4,8-dioxa-1,11-undecadiol, 2,6,10,14-tetra(hydroxymethyl)-2,6,10,14-tetramethyl-4,8,12-trioxa-1,15-pentadecadiol, di(pentaerythritol), tri(pentaerythritol), tetra(pentaerythritol), and penta(pentaerythritol).

Among them, trimethylolpropane, neopentyl glycol, pentaerythritol, and bimolecular or trimolecular dehydrated condensates thereof are preferred, and trimethylolpropane, neopentyl glycol, and pentaerythritol are more preferred, and trimethylolpropane is still more preferred.

The aliphatic monocarboxylic acid includes a saturated aliphatic monocarboxylic acid having 5 to 22 carbon atoms.

The acyl group of the saturated aliphatic monocarboxylic acid may be either linear or branched.

Examples of the saturated aliphatic monocarboxylic acid include a linear saturated monocarboxylic acid such as valeric acid, caproic acid, enanthic acid, caprylic acid, pelargonic acid, capric acid, undecanoic acid, lauric acid, tridecanoic acid, myristic acid, pentadecanoic acid, palmitic acid, heptadecanoic acid, stearic acid, nonadecanoic acid, arachic acid, and behenic acid; and a branched saturated monocarboxylic acid such as isomyristic acid, isopalmitic acid, isostearic acid, 2,2-dimethylpropanoic acid, 2,2-dimethylbutanoic acid, 2,2-dimethylpentanoic acid, 2,2-dimethyloctanoic acid, 2-ethyl-2,3,3-trimethylbutanoic acid, 2,2,3,4-tetramethylpentanoic acid, 2,5,5-trimethyl-2-t-butylhexanoic acid, 2,3,3-trimethyl-2-ethylbutanoic acid, 2,3-dimethyl-2-isopropylbutanoic acid, 2-ethylhexanoic acid, and 3,5,5-trimethylhexanoic acid.

In esterification, these aliphatic monocarboxylic acids may be used alone or in combination of two or more kinds thereof.

The number of carbon atoms of the saturated aliphatic monocarboxylic acid is preferably 5 to 18, more preferably 6 to 14, and still more preferably 8 to 10.

The kinematic viscosity at 40° C. of the polyol ester (A2) used in one embodiment of the present invention is preferably 8 $mm^2/s$ to 350 $mm^2/s$, more preferably 10 $mm^2/s$ to 150 $mm^2/s$, still more preferably 12 $mm^2/s$ to 100 $mm^2/s$, and even still more preferably 15 $mm^2/s$ to 68 $mm^2/s$.

Further, the viscosity index of the polyol ester (A2) used in one embodiment of the present invention is preferably 90 or more, more preferably 100 or more, still more preferably 110 or more, and even still more preferably 120 or more.

The number average molecular weight (Mn) of the polyol ester (A2) used in one embodiment of the present invention is preferably 100 to 8,000, more preferably 200 to 4,000, still more preferably 300 to 2,000, and even still more preferably 400 to 1,000.

In the lubricating oil composition of one embodiment of the present invention, the content of the polyol ester (A2) is preferably 5% by mass or more, more preferably 10% by mass or more, still more preferably 20% by mass or more, and even still more preferably 30% by mass or more, based on the total amount (100% by mass) of the lubricating oil composition, from the viewpoint of providing a lubricating oil composition having the effect of suppressing excessive deterioration of the component (A1) according to use, having excellent oxidation stability and strong effect of suppressing sludge precipitation, and preferably 85% by mass or less, more preferably 80% by mass or less, still more preferably 75% by mass or less, and even still more preferably 72% by mass or less, from the viewpoint of providing a lubricating oil composition which secures the content of the component (A1), and is further improved in the effect of suppressing sludge precipitation and the effect of suppressing deterioration of demulsibility due to blending of the additives.

[Synthetic Oil and Mineral Oil Other Than Components (A1) and (A2)]

In one embodiment of the present invention, the base oil (A) may further contain one or more selected from synthetic oils and mineral oils other than the components (A1) and (A2) as long as the effects of the present invention are not impaired.

Examples of synthetic oils other than the components (A1) and (A2) include poly-α-olefins such as α-olefin homopolymers or α-olefin copolymers (for example, α-olefin copolymers having 8 to 14 carbon atoms such as ethylene-α-olefin copolymers); isoparaffin; various esters other than the component (A2), such as dibasic acid esters (for example, ditridecyl glutarate), tribasic acid esters (for example, 2-ethylhexyl trimellitate) and phosphate esters; various ethers other than the component (A1), such as polyphenyl ethers; alkylbenzenes; and alkylnaphthalenes.

Examples of mineral oils include topped crudes obtained through atmospheric distillation of crude oils such as paraffin-based mineral oils, intermediate-based mineral oils and naphthene-based mineral oils; distillates obtained through reduced-pressure distillation of such topped crudes; mineral oils obtained by purifying the distillates through one or more purification treatments of solvent deasphalting, solvent extraction, hydrocracking, solvent dewaxing, catalytic dewaxing, or hydrorefining; and mineral oil waxes obtained by isomerizing a wax produced through Fischer-Tropsch synthesis (GTL wax (Gas To Liquids WAX)).

<Component (B): Phosphorus-Based Rust Inhibitor>

As a phosphorus-based rust inhibitor (B) included in the lubricating oil composition of the present invention, a phosphorus atom-containing compound having rust preventive performance can be used. For example, tricresyl phosphate (TCP) used as the extreme-pressure agent does not correspond to the "phosphorus-based rust inhibitor (B)", since it does not exhibit a sufficient rust preventive performance even when added.

Further, the component (B) may be used alone or in combination of two or more kinds thereof.

In this regard, since the phosphorus-based rust inhibitor (B) which is a phosphorus atom-containing compound has a higher polarity than the base oil (A), it has good compatibility with the base oil (A), and the improved rust preventive properties and the strong effect of suppressing deterioration of demulsibility can be obtained, as compared with use of general rust inhibitors (e.g., alkenyl succinic acid half esters).

The phosphorus-based rust inhibitor (B) also contributes to the improvement of extreme pressure property.

Therefore, by using the phosphorus-based rust inhibitor (B), it is possible to provide a lubricating oil composition which is further improved in the rust preventive properties, the effect of suppressing deterioration of demulsibility, the effect of suppressing sludge precipitation, and extreme pressure property.

The phosphorus-based rust inhibitor (B) used in one embodiment of the present invention includes preferably one or more selected from a neutral phosphate ester (B1) and an amine salt of acidic phosphate ester (B2), and more preferably includes at least neutral phosphate ester (B1), from the viewpoint of providing a lubricating oil composition in which demulsibility and rust preventive properties are improved in a well-balanced manner.

[Neutral Phosphate Ester (B1)]

The neutral phosphate ester (B1) is preferably a compound (B11) represented by the following general formula (b1-1) from the above viewpoint.

(b1-1)

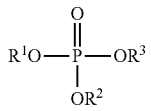

In the general formula (b1-1), $R^1$ to $R^3$ are each independently an alkyl group having 3 to 12 carbon atoms or an aryl group having 6 to 18 ring carbon atoms substituted with an alkyl group having 3 to 12 carbon atoms.

Examples of the alkyl group having 3 to 12 carbon atoms which can be selected as $R^1$ to $R^3$ include a propyl group (a n-propyl group, an isopropyl group), a butyl group (a n-butyl group, an s-butyl, a t-butyl group, an isobutyl group), a pentyl group, a hexyl group, a 2-ethyl hexyl group, a heptyl group, an octyl group, a nonyl group, a decyl group, an undecyl group, and a dodecyl group.

The alkyl group may be either a linear alkyl group or a branched alkyl group.

Examples of the aryl group having 6 to 18 ring carbon atoms include a phenyl group, a naphthyl group, an anthryl group, a phenanthryl group, a biphenyl group, a terphenyl group, and a phenylnaphthyl group, and preferably, a phenyl group.

The "aryl group substituted with an alkyl group having 3 to 12 carbon atoms" which can be selected as $R^1$ to $R^3$ includes a group in which at least one of hydrogen atoms bonded to the ring carbon atoms of the aryl group is substituted with the alkyl group having 3 to 12 carbon atoms.

The compound (B11) is more preferably a compound (B12) represented by the following general formula (b1-2) from the viewpoint of providing a lubricating oil composition in which demulsibility and rust preventive properties are improved in a well-balanced manner.

(b1-2)

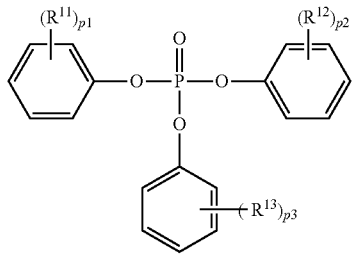

In the general formula (b1-2), $R^{11}$ to $R^{13}$ are each independently an alkyl group having 3 to 12 carbon atoms. The alkyl group may be the same as the alkyl group which can be selected as $R^1$ to $R^3$.

The number of carbon atoms of the alkyl group which can be selected as $R^{11}$ to $R^{13}$ is 3 to 12, preferably 3 to 10, more preferably 3 to 8, still more preferably 3 to 6, and even still more preferably 3.

Further, p1 to p3 are each independently an integer of 1 to 5, preferably an integer of 1 to 2, and more preferably 1.

[Amine Salt of Acidic Phosphate Ester (B2)]

The amine salt of acidic phosphate ester (B2) is preferably one or more selected from an amine salt (B21) of a compound represented by the following general formula (b2-1) and an amine salt (B22) of a compound represented by the following general formula (b2-2) from the viewpoint of providing a lubricating oil composition in which demulsibility and rust preventive properties are improved in a well-balanced manner.

(b2-1)

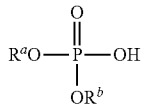

(b2-2)

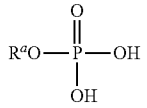

In the general formulae (b2-1) and (b2-2), $R^a$ and $R^b$ are each independently an alkyl group having 3 to 12 carbon atoms. The alkyl group may be the same as the alkyl group which can be selected as $R^1$ to $R^3$.

The number of carbon atoms of the alkyl group which can be selected as $R^a$ and $R^b$ is preferably 3 to 10, more preferably 6 to 10, and still more preferably 8 to 10.

Further, $R^a$ and $R^b$ in the general formula (b2-1) may be the same as or different from each other.

The amine forming the amine salts (B21) and (B22) is preferably a compound represented by the following general formula (b2-i). The amine may be used alone or in combination of two or more kinds thereof.

$$(R^C)_q—N—(H)_{3-q} \quad \text{(b2-i)}$$

In the general formula (b2-i), q is an integer of 1 to 3, and preferably 1.

$R^C$ is each independently an alkyl group having 6 to 18 carbon atoms, an alkenyl group having 6 to 18 carbon atoms, an aryl group having 6 to 18 ring carbon atoms, an arylalkyl group having 7 to 18 carbon atoms, or a hydroxyalkyl group having 6 to 18 carbon atoms, and preferably, an alkyl group having 6 to 18 carbon atoms.

Further, when there are a plurality of $R^C$s, $R_C$s may be the same as or different from each other.

Examples of the alkyl group which can be selected as $R^C$ include a hexyl group, a heptyl group, an octyl group, a 2-ethylhexyl group, a nonyl group, a decyl group, an undecyl group, a dodecyl group, a tridecyl group, a tetradecyl group, a hexadecyl group, and an octadecyl group.

The alkyl group may be either a linear alkyl group or a branched alkyl group.

The number of carbon atoms of the alkyl group which can be selected as $R^C$ is 6 to 18, preferably 7 to 16, more preferably 8 to 15, and still more preferably 10 to 13.

Examples of the alkenyl group which can be selected as $R^C$ include a hexenyl group, a heptenyl group, an octenyl group, a nonenyl group, a decenyl group, an undecenyl group, a dodecenyl group, a tridecenyl group, a tetradecenyl group, a hexadecenyl group, and an octadecenyl group.

The alkenyl group may be either a linear alkenyl group or a branched alkenyl group.

The number of carbon atoms of the alkenyl group which can be selected as $R^C$ is 6 to 18, preferably 7 to 16, more preferably 8 to 15, and still more preferably 10 to 13.

Examples of the aryl group which can be selected as $R^C$ include a phenyl group, a naphthyl group, an anthryl group, a phenanthryl group, a biphenyl group, a terphenyl group, and a phenylnaphthyl group.

The number of carbon atoms of the aryl group which can be selected as $R^C$ is 6 to 18, preferably 6 to 16, and more preferably 6 to 14.

The arylalkyl group which can be selected as $R^C$ includes a group in which a hydrogen atom of the alkyl group is substituted with the aryl group, and specifically, a phenylmethyl group, and a phenylethyl group.

The number of carbon atoms of the arylalkyl group which can be selected as $R^C$ is 7 to 18, preferably 7 to 16, and more preferably 8 to 14.

The hydroxyalkyl group which can be selected as $R^C$ includes a group in which a hydrogen atom of the alkyl group is substituted with a hydroxy group, and specifically, a hydroxyhexyl group, a hydroxyoctyl group, a hydroxydodecyl group, and a hydroxytridecyl group.

The number of carbon atoms of the hydroxyalkyl group which can be selected as $R^C$ is 6 to 18, preferably 7 to 16, more preferably 8 to 15, and still more preferably 10 to 13.

In the lubricating oil composition of one embodiment of the present invention, the content of the phosphorus-based rust inhibitor (B) in terms of phosphorus atom is preferably 10 ppm by mass or more, more preferably 15 ppm by mass or more, still more preferably 20 ppm by mass or more, and even still more preferably 50 ppm by mass or more, based on the total amount (100% by mass) of the lubricating oil composition, from the viewpoint of providing a lubricating oil composition in which demulsibility and rust preventive properties are improved in a well-balanced manner.

The content of the phosphorus-based rust inhibitor (B) in terms of phosphorus atom is preferably 1,600 ppm by mass or less, more preferably 1,200 ppm by mass or less, still more preferably 1,000 ppm by mass or less, even still more preferably 800 ppm by mass or less, and particularly preferably 600 ppm by mass or less, based on the total amount (100% by mass) of the lubricating oil composition, from the viewpoint of providing a lubricating oil composition suppressing generation of deterioration products and having excellent oxidation stability.

In the lubricating oil composition of one embodiment of the present invention, the content of the phosphorus-based rust inhibitor (B) is preferably 0.010% by mass to 2% by mass, more preferably 0.015% by mass to 1.5% by mass, still more preferably 0.018% by mass to 1.0% by mass, and even still more preferably 0.020% by mass to 0.5% by mass, based on the total amount (100% by mass) of the lubricating oil composition, from the above viewpoint.

In the lubricating oil composition of one embodiment of the present invention, the content ratio of the component (B) relative to 100 parts by mass of the component (A1) is preferably 0.01 parts by mass to 4.0 parts by mass, more preferably 0.03 parts by mass to 3.0 parts by mass, still more preferably 0.05 parts by mass to 2.0 parts by mass, and even still more preferably 0.07 parts by mass to 1.0 part by mass, from the viewpoint of providing a lubricating oil composition in which the component (B) is dissolved in the base oil (A) and demulsibility and rust preventive properties are improved in a well-balanced manner.

In the lubricating oil composition of one embodiment of the present invention, the content ratio of the component (B) relative to 100 parts by mass of the component (A2) is preferably 0.01 part by mass to 2.0 parts by mass, more preferably 0.015 parts by mass to 1.0 parts by mass, still more preferably 0.02 parts by mass to 0.7 parts by mass, and even still more preferably 0.03 parts by mass to 0.4 parts by mass, from the viewpoint of providing a lubricating oil composition in which the component (B) is dissolved in the base oil (A) and demulsibility and rust preventive properties are improved in a well-balanced manner.

<Component (C): Antioxidant>

The lubricating oil composition of the present invention includes an antioxidant (C) containing an amine-based antioxidant (C1), from the viewpoint of providing a lubricating oil composition which is excellent in oxidation stability, suppresses generation of deterioration products, and is further improved in the effect of suppressing sludge precipitation.

In one embodiment of the present invention, the antioxidant (C) may further contain an antioxidant other than the amine-based antioxidant (C1), together with the amine-based antioxidant (C1), within a range not impairing the effect of the present invention.

In the lubricating oil composition of one embodiment of the present invention, the content of the antioxidant (C) is preferably 0.01% by mass to 10% by mass, more preferably 0.05% by mass to 7% by mass, and still more preferably 0.1% by mass to 5% by mass, based on the total amount (100% by mass) of the lubricating oil composition, from the viewpoint of providing a lubricating oil composition which suppresses generation of deterioration products, is further improved in the effect of suppressing sludge precipitation, and has excellent oxidation stability.

In the lubricating oil composition of one embodiment of the present invention, the content ratio of the amine-based antioxidant (C1) in the antioxidant (C) is preferably 30% by mass to 100% by mass, more preferably 50% by mass to 100% by mass, still more preferably 60% by mass to 100% by mass, and even still more preferably 70% by mass to 100% by mass, based on the total amount (100% by mass) of the antioxidant (C) included in the lubricating oil composition, from the viewpoint of providing a lubricating oil composition which suppresses generation of deterioration products, is further improved in the effect of suppressing sludge precipitation, and has excellent oxidation stability.

[Component (C1): Amine-Based Antioxidant]

The amine-based antioxidant (C1) may be an amine-based compound having antioxidant performance, and includes naphthylamine (C11), diphenylamine (C12) and the like.

The amine-based antioxidant (C1) may be used alone or in combination of two or more kinds thereof.

Further, in one embodiment of the present invention, both naphthylamine (C11) and diphenylamine (C12) are preferably included.

In the lubricating oil composition of one embodiment of the present invention, the content ratio [(C11)/(C12)] of the naphthylamine (C11) and the diphenylamine (C12) is preferably 10/90 to 90/10, more preferably 15/85 to 85/15, still more preferably 20/80 to 80/20, and even still more preferably 25/75 to 75/25 by a mass ratio.

Examples of the naphthylamine (C11) include phenyl-α-naphthylamine, phenyl-β-naphthylamine, alkylphenyl-α-naphthylamine, and alkylphenyl-β-naphthylamine, and preferably, alkylphenyl-α-naphthylamine.

The number of carbon atoms of the alkyl group in the alkylphenyl-α-naphthylamine is preferably 1 to 30, still more preferably 1 to 20, still more preferably 4 to 16, and even still more preferably 6 to 14 from the viewpoint of improving the solubility with the base oil (A) and further improving the effect of suppressing sludge precipitation at the same time.

The diphenylamine (C12) is preferably a compound represented by the following general formula (c-1) and more preferably a compound represented by the following general formula (c-2).

(c-1)

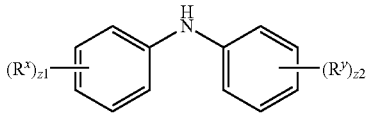

(c-2)

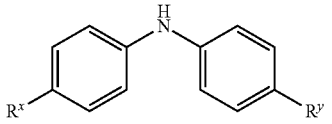

In the general formulae (c-1) and (c-2), $R^x$ and $R^y$ are each independently an alkyl group having 1 to 30 carbon atoms, or an alkyl group having 1 to 30 carbon atoms substituted with an aryl group having 6 to 18 ring atoms.

The alkyl group may be either a linear alkyl group or a branched alkyl group.

In general formula (c-1), z1 and z2 are each independently an integer of 0 to 5, preferably 0 or 1, and more preferably 1. Further, when there are a plurality of $R^x$ and $R^y$, $R^x$ and $R^y$ may be the same as or different from each other.

Further, the number of carbon atoms of the alkyl group which can be selected as $R^x$ and $R^y$ is 1 to 30, preferably 1 to 20, and more preferably 1 to 10.

Examples of the aryl group that can be substituted for the alkyl group include a phenyl group, a naphthyl group, and a biphenyl group, and preferably, a phenyl group.

Examples of the alkyl group in the alkylphenyl-naphthylamine and the alkyl group in the diphenylamine include a methyl group, an ethyl group, a propyl group, a butyl group, a pentyl group, a hexyl group, a heptyl group, an octyl group, a nonyl group, a decyl group, an undecyl group, a dodecyl group, a hexadecyl group, an octadecyl group, a nonadecyl group, an icosyl group, and a tetracosyl group.

In the lubricating oil composition of one embodiment of the present invention, the content of the amine-based antioxidant (C1) in terms of nitrogen atom is preferably 200 ppm by mass to 3,000 ppm by mass, more preferably 300 ppm by mass to 2,500 ppm by mass, still more preferably 400 ppm by mass to 2,000 ppm by mass, and even still more preferably 500 ppm by mass to 1,500 ppm by mass, based on the total amount (100% by mass) of the lubricating oil composition, from the viewpoint of providing a lubricating oil composition which suppresses generation of deterioration products, is further improved in the effect of suppressing sludge precipitation, and has excellent oxidation stability.

[Antioxidant Other Than Amine-Based Antioxidant (C1)]

The antioxidant (C) may also contain an antioxidant other than the above amine-based antioxidant (C1). As such an antioxidant, a phenol-based antioxidant is preferred.

Examples of the phenol-based antioxidant include monocyclic phenol compounds such as 2,6-di-t-butyl-4-methylphenol, 2,6-di-t-butyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4-(N,N-dimethylaminomethyl)phenol, 2,6-di-t-amyl-4-methylphenol, and n-octadecyl-3-(3,5-di-t-butyl-4-hydroxyphenyl)propionate; and polycyclic phenol compounds such as 4,4'-methylenebis(2,6-di-t-butylphenol), 4,4'-isopropylidenebis(2,6-di-t-butylphenol), 2,2'-methylenebis(4-methyl-6-t-butylphenol), 4,4'-bis(2,6-di-t-butylphenol), 4,4'-bis(2-methyl-6-t-butylphenol), 2,2'-methylenebis(4-ethyl-6-t-butylphenol), and 4,4'-butylidenebis(3-methyl-6-t-butylphenol).

In the lubricating oil composition of one embodiment of the present invention, the content ratio of the phenol-based antioxidant relative to 100 parts by mass of the amine-based antioxidant (C1) is preferably 0 part by mass to 100 parts by mass, more preferably 0 part by mass to 60 parts by mass, and still more preferably 0 part by mass to 40 parts by mass.

<Component (D): Metal Deactivator>

The lubricating oil composition of one embodiment of the present invention may further include a metal deactivator (D) from the viewpoint of suppressing corrosion on a metal member to be lubricated.

Examples of the metal deactivator (D) include a benzotriazole compound, a tolyltriazole-based compound, a thiadiazole-based compound, an imidazole-based compound, and a pyrimidine-based compound.

These metal deactivator (D) may be used alone or in combination of two or more kinds thereof.

In one embodiment of the present invention, the metal deactivator (D) is preferably a benzotriazole-based compound.

The benzotriazole-based compound includes 1,2,3-benzotriazole represented by the following general formula (d), alkylbenzotriazole represented by the following general formula (d-1), and aminoalkylbenzotriazole represented by the following general formula (d-2), and preferably, 1,2,3-benzotriazole.

(d)

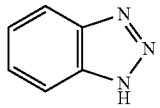

-continued (d-1)

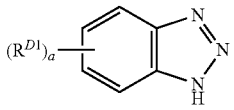

(d-2)

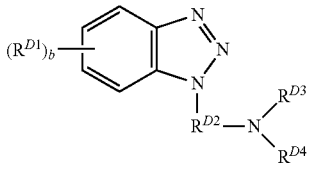

In the general formulae (d-1) and (d-2), $R^{D1}$ is each independently an alkyl group having 1 to 4 carbon atoms, wherein the alkyl group may be a linear alkyl group or a branched alkyl group. Further, when there are a plurality of $R^{D1}$s, $R^{D1}$s may be the same as or different from each other.

a is an integer of 1 to 4, and preferably 1 or 2.

b is an integer of 0 to 4, and preferably an integer of 0 to 2.

$R^{D2}$ is a methylene group or an ethylene group.

$R^{D3}$ and $R^{D4}$ are each independently a hydrogen atom or an alkyl group having 1 to 18 carbon atoms, wherein the alkyl group may be a linear alkyl group or a branched alkyl group.

In the lubricating oil composition of one embodiment of the present invention, the content of the metal deactivator (D) is preferably 0.01% by mass to 5% by mass, more preferably 0.02% by mass to 2% by mass, still more preferably 0.03% by mass to 1% by mass, and even still more preferably 0.04% by mass to 0.5% by mass, based on the total amount (100% by mass) of the lubricating oil composition.

<Other Additive for Lubricating Oil>

The lubricating oil composition of one embodiment of the present invention may contain additives for lubricating oil other than the components (B) to (D), as long as the effects of the present invention are not impaired.

Examples of the additive for lubricating oil include an extreme-pressure agent, a detergent dispersant, a viscosity index improver, an anti-foaming agent, a friction modifier, and an anti-wear agent.

These additives for lubricating oil may be used alone or in combination of two or more kinds thereof.

When these additives for lubricating oil are blended, the content of each of the additives for lubricating oil is appropriately adjusted depending on the type of the additive as long as the effects of the present invention are not impaired, and the content is generally 0.001% by mass to 10% by mass, preferably 0.005% by mass to 5% by mass, and more preferably 0.01% by mass to 2% by mass, based on the total amount (100% by mass) of the lubricating oil composition.

Further, the lubricating oil composition of one embodiment of the present invention may include a rust inhibitor which does not correspond to the component (B), as long as the effects of the present invention are not impaired, but it is preferable that the lubricating oil composition does not include the rust inhibitor.

For example, when alkenyl succinic acid ester generally used as an rust inhibitor is blended with the base oil (A) used in the present invention, compatibility of the alkenyl succinic acid ester with the base oil (A) becomes poor because of high polarity of the base oil (A), and the improvement of the rust preventive properties are insufficient.

Although organic metal sulfonate salts are also known as rust inhibitors, there is a concern about deterioration of demulsibility by blending with organic metal sulfonate salts, because of their high solubility with water.

Considering the above-mentioned content, in the lubricating oil composition of one embodiment of the present invention, the content of the rust inhibitor which does not correspond to the component (B) is preferably less than 10 parts by mass, more preferably less than 3 parts by mass, still more preferably less than 1 part by mass, and even still more preferably less than 0.1 part by mass relative to 100 parts by mass of the component (B).

It is preferable that the lubricating oil composition of one embodiment of the present invention substantially does not include a metal atom-containing compound from the viewpoint of suppressing sludge generated during long-term use under high-temperature environments.

Here, the metal atom contained in the "metal atom-containing compound" indicates an alkali metal atom, an alkaline earth atom, or a transition metal atom.

Also, in the present description, "substantially does not include a metal atom-containing compound" is to exclude a mode of intentionally including the metal atom-containing compound for a predetermined purpose, and is not to exclude the case of including the metal atom-containing compound as an impurity.

However, it is preferable that the content of the metal atom-containing compound included as an impurity is as small as possible.

In the lubricating oil composition of one embodiment of the present invention, the content of the metal atom is preferably less than 100 ppm by mass, more preferably less than 50 ppm by mass, still more preferably less than 10 ppm by mass, and even still more preferably less than 5 ppm by mass, based on the total amount (100% by mass) of the lubricating oil composition, from the viewpoint of suppressing sludge generated during long-term use under high-temperature environments.

In the present description, the content of the metal atom means a value measured in accordance with JPI-5S-38-92.

[Various Physical Properties of Lubricating Oil Composition]

The kinematic viscosity at 40° C. of the lubricating oil composition of one embodiment of the present invention is preferably 5 $mm^2/s$ to 300 $mm^2/s$, more preferably 10 $mm^2/s$ to 200 $mm^2/s$, and still more preferably 15 $mm^2/s$ to 100 $mm^2/s$.

The viscosity index of the lubricating oil composition of one embodiment of the present invention is preferably 85 or more, more preferably 90 or more, and still more preferably 95 or more.

In the lubricating oil composition of one embodiment of the present invention, the content of the phosphorus atom is preferably 10 ppm by mass or more, more preferably 15 ppm by mass or more, still more preferably 20 ppm by mass or more, even still more preferably 50 ppm by mass or more, and preferably 1,600 ppm by mass or less, more preferably 1,200 ppm by mass or less, still more preferably 1,000 ppm by mass or less, even still more preferably 800 ppm by mass or less, and particularly preferably 600 ppm by mass or less, based on the total amount (100% by mass) of the lubricating oil composition.

In the lubricating oil composition of one embodiment of the present invention, the content of the nitrogen atom is preferably 200 ppm by mass or more, more preferably 300 ppm by mass or more, still more preferably 400 ppm by mass or more, even still more preferably 500 ppm by mass or more, and preferably 3,000 ppm by mass or less, more preferably 2,600 ppm by mass or less, still more preferably 2,000 ppm by mass or less, and even still more preferably 1,600 ppm by mass or less, based on the total amount (100% by mass) of the lubricating oil composition.

When the lubricating oil composition of one embodiment of the present invention is subjected to a water separability test at a temperature of 54° C. in accordance with JIS K2520, demulsibility that is represented by the time taken for an emulsion layer to reach 3 mL is preferably 20 minutes or less, more preferably 15 minutes or less, still more preferably 10 minutes or less, and even still more preferably 5 minutes or less.

When the lubricating oil composition of one embodiment of the present invention is tested according to the oxidation stability test (Dry-TOST method) of ASTM D7873, the amount of sludge precipitated at 120 hours after initiation of the test under environment of 150° C. is preferably less than 50 mg/kg, more preferably less than 20 mg/kg, still more preferably less than 10 mg/kg, and even still more preferably 5 mg/kg or less.

The amount of the precipitated sludge is a value measured in accordance with ASTM D7873 using a membrane filter having an average pore diameter of 1.0 μm.

[Method of Producing Lubricating Oil Composition]

A method of producing the lubricating oil composition of the present invention may be a method including the step of blending the base oil (A) containing the polyalkylene glycol (A1) and the polyol ester (A2) with the phosphorus-based rust inhibitor (B) and the antioxidant (C) containing the amine-based antioxidant (C1).

At that time, if desired, the metal deactivator (D) and the additives for lubricating oil may be blended.

Further, preferred compounds, physical property values, and contents of the above components (A) to (D), and various properties and physical property values of the obtained lubricating oil composition are the same as described above.

[Application of Lubricating Oil Composition, and Lubrication Method]

The lubricating oil composition of the present invention is used in turbomachinery, compressors (excluding a freezer), hydraulic equipments, or machine tools.

Specifically, the lubricating oil composition of one embodiment of the present invention may be appropriately used as lubricating oils (pump oils or turbine oils) for turbomachinery, which are used for lubrication of turbomachinery such as pumps, vacuum pumps, blowers, turbo compressor, steam turbines, nuclear turbines, gas turbines, turbines for hydroelectric power generation; bearing oils, gear oils, or control system operating oils, which are used for lubrication of compressors such as rotary compressors and reciprocating compressors; hydraulic oils which are used in hydraulic equipments; lubricating oils for machine tools, which are used in hydraulic unit of machine tools.

That is, the present invention can also provide "a method of using the lubricating oil composition of the present invention, wherein the lubricating oil composition is used in turbomachinery, compressors, hydraulic equipments, or machine tools".

The specific constitution of the lubricating oil composition of the present invention and specific examples of the turbomachinery, compressors, hydraulic equipments, and machine tools are as described above.

EXAMPLES

The present invention will be described in more detail with reference to Examples below, but the present invention is not limited to these Examples.

[Measurement Methods of Various Physical Property Values]

(1) Kinematic viscosity, Viscosity index

Measured and calculated in accordance with JIS K2283.

(2) Number average molecular weight (Mn)

Mn was measured in terms of standard polystyrene according to gel permeation chromatography (GPC) under the following measurement conditions.

(Measurement Conditions)

Gel permeation chromatography apparatus: "1260 type HPLC" manufactured by Agilent Co.

Standard sample: polystyrene

Column: One in which two of "Shodex LF404" were successively connected to each other Column temperature: 35° C.

Developing solvent: Chloroform

Flow rate: 0.3 mL/min (3) Contents of phosphorus and metal atoms

Measured in accordance with JPI-5S-38-92.

(4) Contents of nitrogen atom

Measured in accordance with JIS K2609.

Examples 1 to 5 and Comparative Examples 1 to 9

The base oil, phosphorus-based rust inhibitor, amine-based antioxidant, phenol-based antioxidant, and other additives shown below were blended at the blending ratio shown in Tables 1 and 2, and fully mixed to prepare lubricating oil compositions (I) to (V) and (i) to (ix), respectively.

The details of the respective components used in the preparation of the lubricating oil compositions are as mentioned below.

(Base Oil)

"PAG": Polypropylene glycol of which one end is sealed with butyl ether which is represented by H—$(OCH(CH_3)CH_2)_a$—$OC_4H_9$ (in the general formula (a-1), $R^{A1}$ is a hydrogen atom, $R^{A2}$ is a propylene group, $R^{A3}$ is a n-butyl group, and b is 1). Kinematic viscosity at 40° C.=37.24 $mm^2/s$, viscosity index=173, Mn=800.

"POE": Trimethylolpropane triester (complete ester of trimethylolpropane and carboxylic acid having 8 to 10 carbon atoms). Kinematic viscosity at 40° C.=19.61 $mm^2/s$, viscosity index=138.

(Phosphorus-Based Rust Inhibitor)

"Amine salt of acidic phosphate ester": A salt of dodecylamine ($CH_3(CH_2)_{11}NH_2$) of a compound wherein $R^a$ and $R^b$ in the general formula (b2-1) are an octyl group or a decyl group, Phosphorus atom content=8.11% by mass.

"Neutral phosphate ester": Tris(p-isopropylphenyl)phosphate, in the general formula (b1-2), p1 to p3 are 1, and $R^{11}$ to $R^{13}$ are isopropyl groups, wherein the isopropyl group is bonded to the para-position. Phosphorus atom content=6.8% by mass.

(Amine-Based Antioxidant)

"Naphthylamine": p-octylphenyl-α-naphthylamine, nitrogen atom content=4.2% by mass.

"Diphenylamine (1)": Bis(p-octylphenyl)amine, nitrogen atom content=3.6% by mass.

"Diphenylamine (2)": Butylphenyloctylphenylamine, in the general formula (c-2), one of $R^x$ and $R^y$ is a n-butyl group and the other is a n-octyl group. Nitrogen atom content=4.1% by mass.

(Phenol-Based Antioxidant)

"BHT": Dibutylhydroxytoluene (another name: 2,6-di-t-butyl-4-methylphenol).

(Other Additives)

"Barium salt of naphthalenesulfonic acid"

"Alkenylsuccinic acid half ester"

"Metal deactivator": 1,2,3-benzotriazole, nitrogen atom content=35.6% by mass.

"Phosphorus-based extreme-pressure agent": tricresyl phosphate, phosphorus atom content=8.4% by mass.

With respect to each of the prepared lubricating oil compositions, various physical property values shown in Tables 1 and 2 were measured according to the above methods, and various properties of the lubricating oil compositions were evaluated by conducting the following tests. The results are shown in Tables 1 and 2.

(1) Rust Preventive Performance Test

The presence or absence of rust was confirmed under conditions of 60° C. for 24 hours in accordance with JIS K2510 (method B, artificial seawater method).

(2) Water Separability Test

A water separability test was conducted at a temperature of 54° C. in accordance with JIS K2520 to measure the time (demulsibility unit: min) taken for an emulsion layer to reach 3 mL.

(3) Oxidation Stability Test (Dry-TOST)

The amount of sludge precipitated at 120 hours after initiation of the test under environment of 150° C. was measured in accordance with the oxidation stability test (Dry-TOST method) of ASTM D7873. Further, the amount of the precipitated sludge was measured in accordance with ASTM D7873 using a membrane filter having an average pore diameter of 1.0 μm (provided by Millipore Corporation).

TABLE 1

| | | | | Example 1 | Example 2 | Example 3 | Example 4 | Example 5 |
|---|---|---|---|---|---|---|---|---|
| Lubricating oil composition | | | | (I) | (II) | (III) | (IV) | (V) |
| Composition | Base oil | PAG | % by mass | 29.62 | 29.55 | 31.75 | 32.00 | 48.81 |
| | | POE | % by mass | 68.00 | 68.00 | 66.17 | 65.52 | 48.81 |
| | Phosphorus-based rust inhibitor | Amine salt of acidic phosphate ester | % by mass | 0.03 | | 0.03 | 0.03 | 0.03 |
| | | Neutral phosphate ester | % by mass | | 0.10 | | | |
| | Other additives | Barium salt of naphthalenesulfonic acid | % by mass | | | | | |
| | | Alkenylsuccinic acid half ester | % by mass | | | | | |
| | Amine-based antioxidant | Naphthylamine | % by mass | 1.50 | 0.80 | | 1.00 | 1.50 |
| | | Diphenylamine (1) | % by mass | 0.80 | 1.50 | | 1.40 | 0.80 |
| | | Diphenylamine (2) | % by mass | | | 2.00 | | |
| | Phenol-based antioxidant | BHT | % by mass | | | | | |

TABLE 1-continued

| | | | | Example 1 | Example 2 | Example 3 | Example 4 | Example 5 |
|---|---|---|---|---|---|---|---|---|
| | Other additives | Metal deactivator | % by mass | 0.05 | 0.05 | 0.05 | 0.05 | 0.05 |
| | | Phosphorus-based extreme-pressure agent | % by mass | | | | | |
| | — | Total | % by mass | 100.00 | 100.00 | 100.00 | 100.00 | 100.00 |
| Content of PAG based on total amount (100% by mass) of base oil | | | % by mass | 30.3 | 30.3 | 32.4 | 32.8 | 50.0 |
| Content of POE based on total amount (100% by mass) of base oil | | | % by mass | 69.7 | 69.7 | 67.6 | 67.2 | 50.0 |
| Content of phosphorus-based rust inhibitor relative to 100 parts by mass of POE | | | part by mass | 0.04 | 0.15 | 0.05 | 0.05 | 0.06 |
| Content of phosphorus-based rust inhibitor in terms of phosphorus atom | | | ppm by mass | 24 | 68 | 24 | 24 | 24 |
| Content of amine-based antioxidant in terms of nitrogen atom | | | ppm by mass | 918 | 876 | 820 | 924 | 918 |
| Content of phosphorus atoms based on total amount of lubricating oil composition | | | ppm by mass | 24 | 68 | 24 | 24 | 24 |
| Content of nitrogen atoms based on total amount of lubricating oil composition | | | ppm by mass | 1096 | 1054 | 998 | 1102 | 1096 |
| Content of metal atoms based on total amount of lubricating oil composition | | | ppm by mass | Less than 5 | Less than 5 | Less than 5 | Less than 5 | Less than 5 |
| Evaluation test | (1) Rust preventive performance test, Presence or absence of rust | | — | No rust | No rust | No rust | No rust | No rust |
| | (2) Water separability test, Demulsibility | | min | 10 | 5 | 10 | 10 | 20 |
| | (3) Oxidation stability test (Dry-TOST), Sludge precipitation amount | | mg/kg | 5 | 3 | 1 | 5 | 5 |

TABLE 2

| | | | | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|---|---|---|
| Lubricating oil composition | | | | (i) | (ii) | (iii) | (iv) | (v) | (vi) | (vii) | (viii) | (ix) |
| Composition | Base oil | PAG | % by mass | 29.45 | 29.55 | 97.62 | | 29.55 | 29.65 | 30.42 | 29.95 | 30.45 |
| | | POE | % by mass | 67.70 | 68.00 | | 97.62 | 68.00 | 68.00 | 69.50 | 68.50 | 69.50 |
| | Phosphorus-based rust inhibitor | Amine salt of acidic phosphate ester | % by mass | | | 0.03 | 0.03 | | | 0.03 | | |
| | | Neutral phosphate ester | % by mass | | | | | | | | | |
| | Other additives | Barium salt of naphthalenesulfonic acid | % by mass | 0.50 | | | | | | | | |
| | | Alkenylsuccinic acid half ester | % by mass | | 0.10 | | | | | | | |
| | Amine-based antioxidant | Naphthylamine | % by mass | 1.50 | 1.50 | 1.50 | 1.50 | 0.80 | 1.50 | | | |
| | | Diphenylamine (1) | % by mass | 0.80 | 0.80 | 0.80 | 0.80 | 1.50 | 0.80 | | | |
| | | Diphenylamine (2) | % by mass | | | | | | | | | |
| | Phenol-based antioxidant | BHT | % by mass | | | | | | | | 1.50 | |
| | Other additives | Metal deactivator | % by mass | 0.05 | 0.05 | 0.05 | 0.05 | 0.05 | 0.05 | 0.05 | 0.05 | 0.05 |
| | | Phosphorus-based extreme-pressure agent | % by mass | | | | | 0.10 | | | | |
| | — | Total | % by mass | 100.00 | 100.00 | 100.00 | 100.00 | 100.00 | 100.00 | 100.00 | 100.00 | 100.00 |
| Content of PAG based on total amount (100% by mass) of base oil | | | % by mass | 30.3 | 30.3 | 100.0 | 0.0 | 30.3 | 30.4 | 30.4 | 30.4 | 30.5 |
| Content of POE based on total amount (100% by mass) of base oil | | | % by mass | 69.7 | 69.7 | 0.0 | 100.0 | 69.7 | 69.6 | 69.6 | 69.6 | 69.5 |
| Content of phosphorus-based rust inhibitor relative to 100 parts by mass of POE | | | part by mass | 0 | 0 | — | 0.003 | 0 | 0 | 0.04 | 0 | 0 |
| Content of phosphorus-based rust inhibitor in terms of phosphorus atom | | | ppm by mass | 0 | 0 | 24 | 24 | 0 | 0 | 24 | 0 | 0 |
| Content of amine-based antioxidant in terms of nitrogen atom | | | ppm by mass | 918 | 918 | 918 | 918 | 876 | 918 | 0 | 0 | 0 |
| Content of phosphorus atoms based on total amount of lubricating oil composition | | | ppm by mass | Less than 5 | Less than 5 | 24 | 24 | 84 | Less than 5 | 24 | Less than 5 | Less than 5 |
| Content of nitrogen atoms based on total amount of lubricating oil composition | | | ppm by mass | 1096 | 1096 | 1096 | 1096 | 1054 | 1096 | 178 | 178 | 178 |
| Content of metal atoms based on total amount of lubricating oil composition | | | ppm by mass | 350 | Less than 5 | Less than 5 | Less than 5 | Less than 5 | Less than 5 | Less than 5 | Less than 5 | Less than 5 |
| Evaluation test | (1) Rust preventive performance test, Presence or absence of rust | | — | No rust | Rust | No rust | No rust | Rust | Rust | No rust | Rust | Rust |
| | (2) Water separability test, Demulsibility | | min | 60 or more | 20 | 15 | 60 or more | 10 | 5 | 10 | 10 | 10 |
| | (3) Oxidation stability test (Dry-TOST), Sludge precipitation amount | | mg/kg | 106 | 3 | 100 | 25 | 5 | 3 | unmeasurable | 165 | unmeasurable |

The lubricating oil compositions (I) to (V) prepared in Examples 1 to 5 showed strong effects of suppressing sludge precipitation, and excellent demulsibility and rust preventive properties.

In contrast, in the lubricating oil composition (i) prepared in Comparative Example 1, a barium salt of naphthalene-sulfonic acid was used as an rust inhibitor. However, since it contains a metal atom, sludge was easily precipitated and demulsibility was deteriorated.

In the lubricating oil composition (ii) prepared in Comparative Example 2, alkenyl succinic acid half ester was used as an rust inhibitor. However, rust preventive properties against the base oil with high polarity were not sufficiently exhibited and demulsibility was also deteriorated.

In the lubricating oil composition (iii) prepared in Comparative Example 3, only PAG was used as a base oil. However, since PAG has a short oxidation life, PAG was oxidatively degraded with use, and a large amount of sludge was precipitated.

In the lubricating oil composition (iv) prepared in Comparative Example 4, only POE was used as a base oil. However, deterioration of demulsibility due to blending of additives and insufficient suppression of sludge precipitation were observed.

In the lubricating oil compositions (v) to (vi) and (viii) to (ix) prepared in Comparative Examples 5 to 6 and 8 to 9, no phosphorus-based rust inhibitor was used, and therefore, rust preventive properties were not obtained.

In the lubricating oil compositions (vii) to (ix) prepared in Comparative Examples 7 to 9, no amine-based antioxidant was used, and therefore, insufficient suppression of sludge precipitation was observed. Particularly, in Comparative Examples 7 and 9, since the base oil was excessively decomposed and became insoluble in the solution after filtration through a Millipore filter, it was impossible to measure the precipitation amount of sludge.

The invention claimed is:

1. A lubricating oil composition, comprising, based on a total composition weight:

(A) a base oil (A) comprising a polyalkylene glycol (A1), in an amount of greater than 20 wt. %, and a polyol ester (A2) comprising a hindered ester of a hindered polyol comprising a quaternary carbon atom with 1 to 4 methylol groups bonded thereto, with an aliphatic monocarboxylic acid;

(B) 0.02 to 0.5 wt. % of a phosphorus-based rust inhibitor (B); and (C) 0.05 to 2.4 wt. % of an antioxidant (C) comprising an amine-based antioxidant (C1), wherein an [(A1)/(A2)] mass content ratio of the base oil is in a range of from more than 20/80 to 49/51, wherein the phosphorus-based rust inhibitor (B) comprises the amine salt of acidic phosphate ester (B2), which comprises an amine salt (B21) of a compound of formula (b2-1) and/or an amine salt (B22) of a compound of formula (b2-2):

(b2-1)

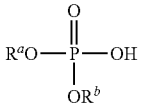

-continued (b2-2)

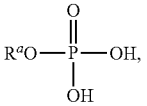

$R^a$ and $R^b$ each independently being an alkyl group having 3 to 12 carbon atoms, wherein the hindered polyol has a formula (a-2):

(a-2)

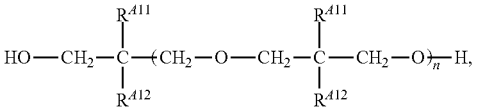

$R^{A11}$ and $R^{A12}$ being independently a monovalent hydrocarbon group having 1 to 6 carbon atoms or a methylol group, and n being an integer in a range of from 0 to 4, and wherein the polyalkylene glycol (A1) is of formula (a-1), and is sealed on at least one end with a substituent:

(a-1)

$$R^{A1}—[(OR^{A2})_a—OR^{A3}]_b,$$

wherein $R^{A1}$ is a hydrogen atom, a monovalent hydrocarbon group having 1 to 10 carbon atoms, an acyl group having 2 to 10 carbon atoms, a divalent to hexavalent hydrocarbon group having 1 to 10 carbon atoms, or a heterocyclic group having 3 to 10 ring atoms, $R^{A2}$ is an alkylene group having 2 to 4 carbon atoms, $R^{A3}$ is a hydrogen atom, a monovalent hydrocarbon group having 1 to 10 carbon atoms, an acyl group having 2 to 10 carbon atoms, or a heterocyclic group having 3 to 10 ring atoms, and b is an integer in a range of from 1 to 6, a is a number of 1 or more.

2. The composition of claim 1, wherein, based on the total composition weight, the content of the polyalkylene glycol (A1) is 25% by mass or more and/or a content of the polyol ester (A2) is 30% by mass or more.

3. The composition of claim 1, wherein a content ratio of the phosphorus-based rust inhibitor (B) relative to 100 parts by mass of the polyol ester (A2) is 0.01 part by mass to 2.0 parts by mass.

4. The composition of claim 1, wherein the phosphorus-based rust inhibitor (B) comprises a neutral phosphate ester (B1) and/or an amine salt of acidic phosphate ester (B2).

5. The composition of claim 4, wherein the phosphorus-based rust inhibitor (B) comprises the neutral phosphate ester (B1), which is a compound (B11) represented by formula (b1-1):

(b1-1)

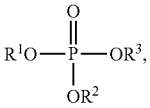

wherein $R^1$ to $R^3$ are each independently an alkyl group having 3 to 12 carbon atoms or an aryl group having 6 to 18 ring carbon atoms substituted with an alkyl group having 3 to 12 carbon atoms.

6. The composition of claim 5, wherein the compound (B11) is a compound (B12) represented by formula (b1-2):

(b1-2)

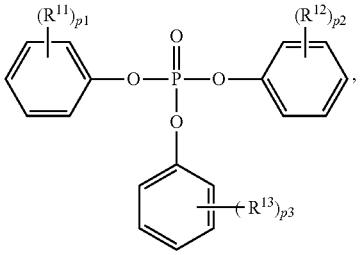

wherein:

$R^{11}$ to $R^{13}$ are each independently an alkyl group having 3 to 12 carbon atoms, and p1 to p3 are each independently an integer of 1 to 5.

7. The composition of claim 1, wherein the content of the phosphorus-based rust inhibitor (B) in terms of phosphorus atom is in a range of from 0.001 to 0.16% by mass, based on the total composition weight.

8. The composition of claim 1, wherein the content of the amine-based antioxidant (C1) in terms of nitrogen atom is in a range of from 0.02 to 0.3% by mass, based on the total composition weight.

9. The composition of claim 1, wherein the content of metal atom is less than 0.01% by mass, based on the total composition weight.

10. The composition of claim 1, wherein, when a water separability test is performed at a temperature of 54° C. in accordance with JIS K2520, demulsibility represented by the time taken for an emulsion layer to reach 3 mL is less than 20 minutes.

11. A method, comprising lubricating an article with the composition of claim 1, wherein the article is turbomachinery, a compressor, hydraulic equipment, or a machine tool.

12. The composition of claim 1, which is adapted to function as a lubricating oil composition for turbomachinery, compressors, hydraulic equipment, or machine tools.

13. The composition of claim 1, wherein n is 0, 1, or 2.

14. The composition of claim 1, wherein the polyalkylene glycol (A1) is sealed on each end with a substituent.

15. The composition of claim 1, wherein $R^{A11}$ and $R^{A12}$ are independently a monovalent hydrocarbon group comprising 1 to 6 carbon atoms.

16. The composition of claim 1, wherein the polyol ester (A2) has a number average molecular weight in a range of from 100 to 8,000.

17. The composition of claim 1, wherein the hindered polyol comprises a dialkylpropanediol with 1 to 6 carbon alkyl groups.

18. The composition of claim 1, wherein the hindered polyol comprises neopentyl glycol, 2-ethyl-2-methyl-1,3-propanediol, 2,2-diethyl-1,3-propanediol, trimethylolethane, trimethylolpropane, trimethylolbutane, trimethylolpentane, trimethylolhexane, trimethylolheptane, pentaerythritol, 2,2,6,6-tetramethyl-4-oxa-1,7-heptanediol, 2,2,6,6,10,10-hexamethyl-4,8-dioxa-1,11-undecadiol, 2,2,6,6,10,10,14,14-octamethyl-4,8,12-trioxa-1,15-pentadecadiol, 2,6-di(hydroxymethyl)-2,6-dimethyl-4-oxa-1,7-heptanediol, 2,6,10-tri(hydroxymethyl)-2,6,10-trimethyl-4,8-dioxa-1,11-undecadiol, 2,6,10,14-tetra(hydroxymethyl)-2,6,10,14-tetramethyl-4,8,12-trioxa-1,15-pentadecadiol, di(pentaerythritol), tri(pentaerythritol), tetra(pentaerythritol), and/or penta(pentaerythritol).

19. The composition of claim 1, wherein the [(A1)/(A2)] mass content ratio of the base oil is in a range of from more than 20/80 to 45/55, and wherein the amine-based antioxidant (C1) is present in a range of from 0.05 to 2.4 wt. %.

20. The composition of claim 1, wherein the base oil is at 85% by mass, relative to the total composition weight, and wherein, in the formula (a-1), $R^{A1}$ is hydrogen atom, a monovalent hydrocarbon group having 1 to 10 carbon atoms, an acyl group having 2 to 10 carbon atoms, a divalent to hexavalent hydrocarbon group having 1 to 10 carbon atoms, or a heterocyclic group having 3 to 10 ring atoms, and $R^{A3}$ is a monovalent hydrocarbon group having 1 to 10 carbon atoms or a heterocyclic group having 3 to 10 ring atoms.

* * * * *